US005379565A

United States Patent [19]

Vienne

[11] Patent Number: 5,379,565

[45] Date of Patent: Jan. 10, 1995

[54] ELEMENT AND METHOD OF CONSTRUCTION WITHOUT MORTAR

[75] Inventor: Fabien Vienne, Gif Sur Yvette, France

[73] Assignee: Brandom, Le Port, France

[21] Appl. No.: 66,150

[22] PCT Filed: Nov. 26, 1991

[86] PCT No.: PCT/FR91/00936

§ 371 Date: May 28, 1993

§ 102(e) Date: May 28, 1993

[87] PCT Pub. No.: WO92/09762

PCT Pub. Date: Jun. 11, 1992

[30] Foreign Application Priority Data

Nov. 29, 1990 [FR] France ..... 90 14964

[51] Int. Cl.[6] ..... E04C 2/04

[52] U.S. Cl. ..... 52/606; 52/605

[58] Field of Search ..... 52/424, 563, 564, 572, 52/603, 604, 605, 606, 607

[56] References Cited

U.S. PATENT DOCUMENTS 4,597,236 7/1986 Braxton .
4,956,958 9/1990 Caroti ..... 52/605
5,154,032 10/1992 Ritter ..... 52/603 X
5,231,813 8/1993 Drawdy ..... 52/605 X

FOREIGN PATENT DOCUMENTS 224012 6/1987 European Pat. Off. ..... 52/605
958351 3/1950 France .
1312989 11/1962 France .
816452 8/1951 Germany .
1759019 8/1971 Germany .
464840 4/1937 United Kingdom .

*Primary Examiner*—Carl D. Friedman
*Assistant Examiner*—Creighton Smith
*Attorney, Agent, or Firm*—Weiser & Associates

[57] ABSTRACT

Element of construction designed to be laid without mortar comprising a block (B1–B4) with six faces (1–6) opposite two-by-two and of which at least one face (1, 2) is punched so as to form open internal cells (7, 7*a*, 7*b*, 7*c*) separated by walls (8), characterized in that said block comprises ribs (9, 9*a*, 9*b*) and grooves (10) which extend in parallel to the edges (1*a*, 1*b*) on at least two faces with a length at the most equal to the greatest dimension of said block as well as a transversal channel of V-shaped cross-section disposed perpendicularly between the longitudinal edge and said rib on the upper face of said block.

14 Claims, 4 Drawing Sheets

ELEMENT AND METHOD OF CONSTRUCTION WITHOUT MORTAR

Figure 3:
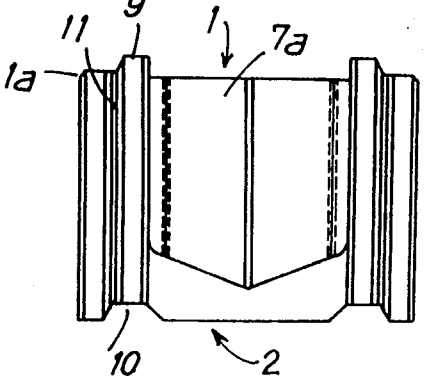

The present invention relates to an element of construction designed to be laid without mortar as well as to a construction method using such element.

In general, buildings are constructed with blocks of stone, concrete or more frequently with solid or hollow building blocks, molded in concrete and bonded together with a mortar.

In certain cases, it may be advantageous to construct the building without mortar by assembling the blocks directly together. With this construction method, insulation and resistance of the building are obtained by imbrication of the blocks one with the other within the walls.

However, with the known blocks, the insulation obtained is unsatisfactory and the mechanical bonding between the blocks is not perfect, this often causing problems of brittleness or balance.

It is the object of the present invention to solve these problems satisfactorily or at least to reduce them.

This object is reached according to the invention with an element of construction designed to be laid without mortar, comprising a block with six faces opposite two-by-two, one face at least being punched so as to provide open internal cells separated by walls, characterized in that said block comprises ribs and grooves which extend in parallel to the edges on at least two faces with a length at the most equal to the greater dimension of said block as well as a transversal channel of V-shaped cross-section disposed perpendicularly between the longitudinal edge and said rib on the upper face of the block.

According to another characteristic of the invention, the position and dimensions of the ribs are determined as a function of the position and dimensions of the grooves so that the blocks can be jointed together by engagement of the ribs of a first block into the grooves of an adjacent block or vice-versa.

According to an advantageous embodiment, the ribs are situated on the upper face and on the lateral face of the block, and the grooves on the lower face.

According to yet another characteristic, said block further comprises on its upper face a transversal groove of V-shaped cross-section disposed perpendicularly between the longitudinal edge and said rib.

According to a variant embodiment, the grooves and ribs are disposed on the upper face and the lower face, respectively, and oriented in perpendicular directions.

According to yet another characteristic, said block is further provided on at least one lateral face with vertical grooves of V-shaped cross-section, opening out on the upper face substantially plumb with the ribs, and on the lower face into or in the immediate vicinity of the grooves.

Another object of the invention is a construction method consisting in assembling said blocks without using mortar, which method is characterized in that said blocks are in parallelepipedal form.

The element of construction according to the invention enables the construction without mortar of dwellings or industrial or commercial premises, the solidity and insulation of which are very satisfactory.

In addition, the construction is considerably speeded up and simplified by the absence of mortar bonds.

Figure 1:
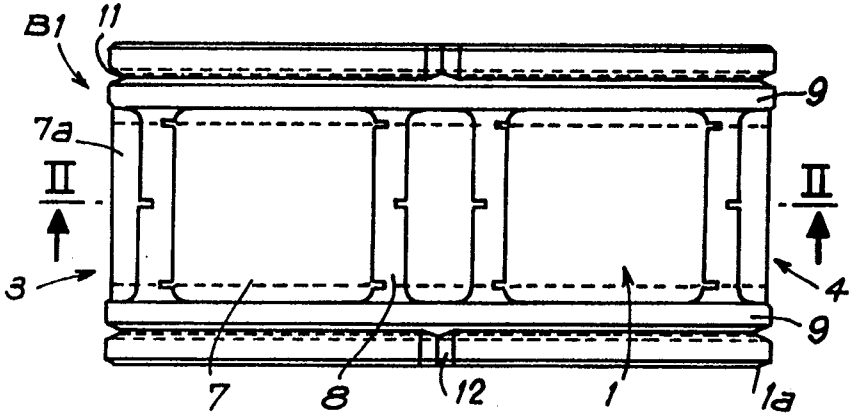
Figure 2:
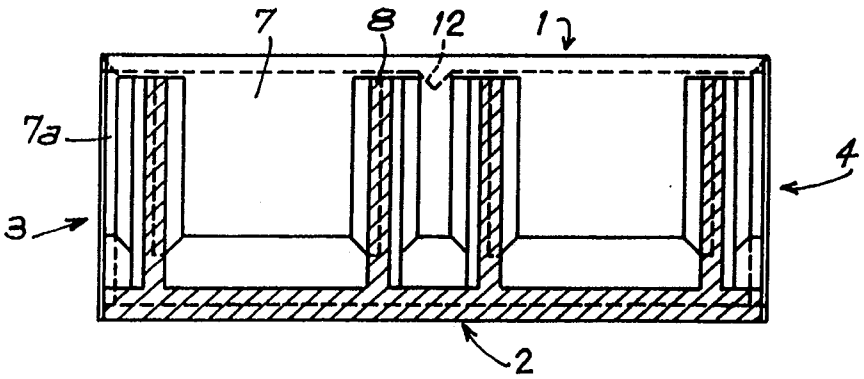
Figure 5:
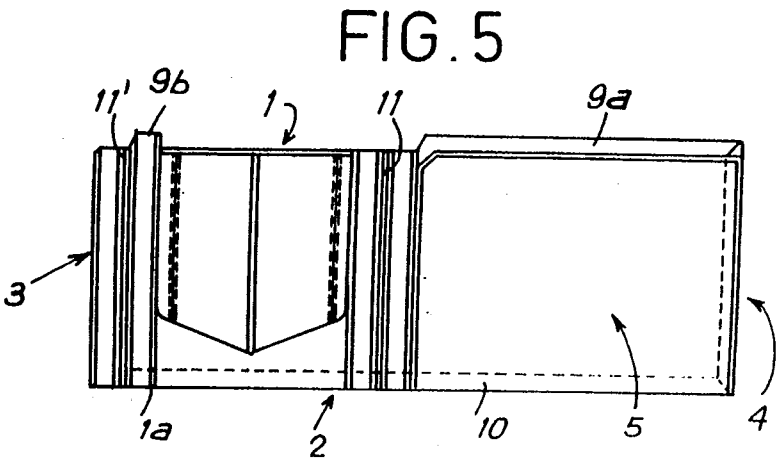
Figure 7:
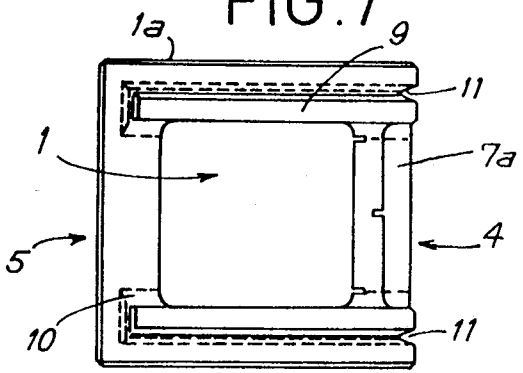
Figure 4:
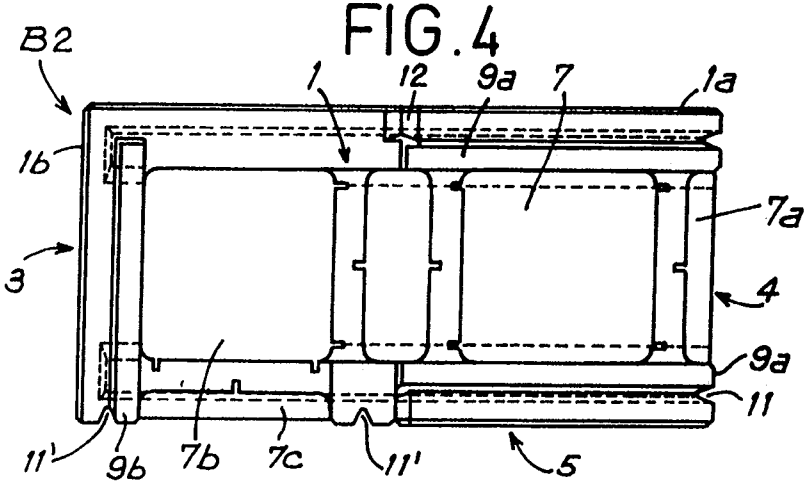
Figure 6:
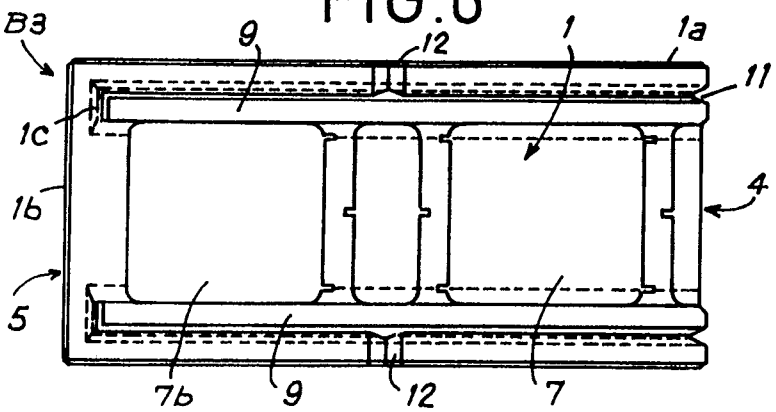
Figures 8, 8A, 8B:
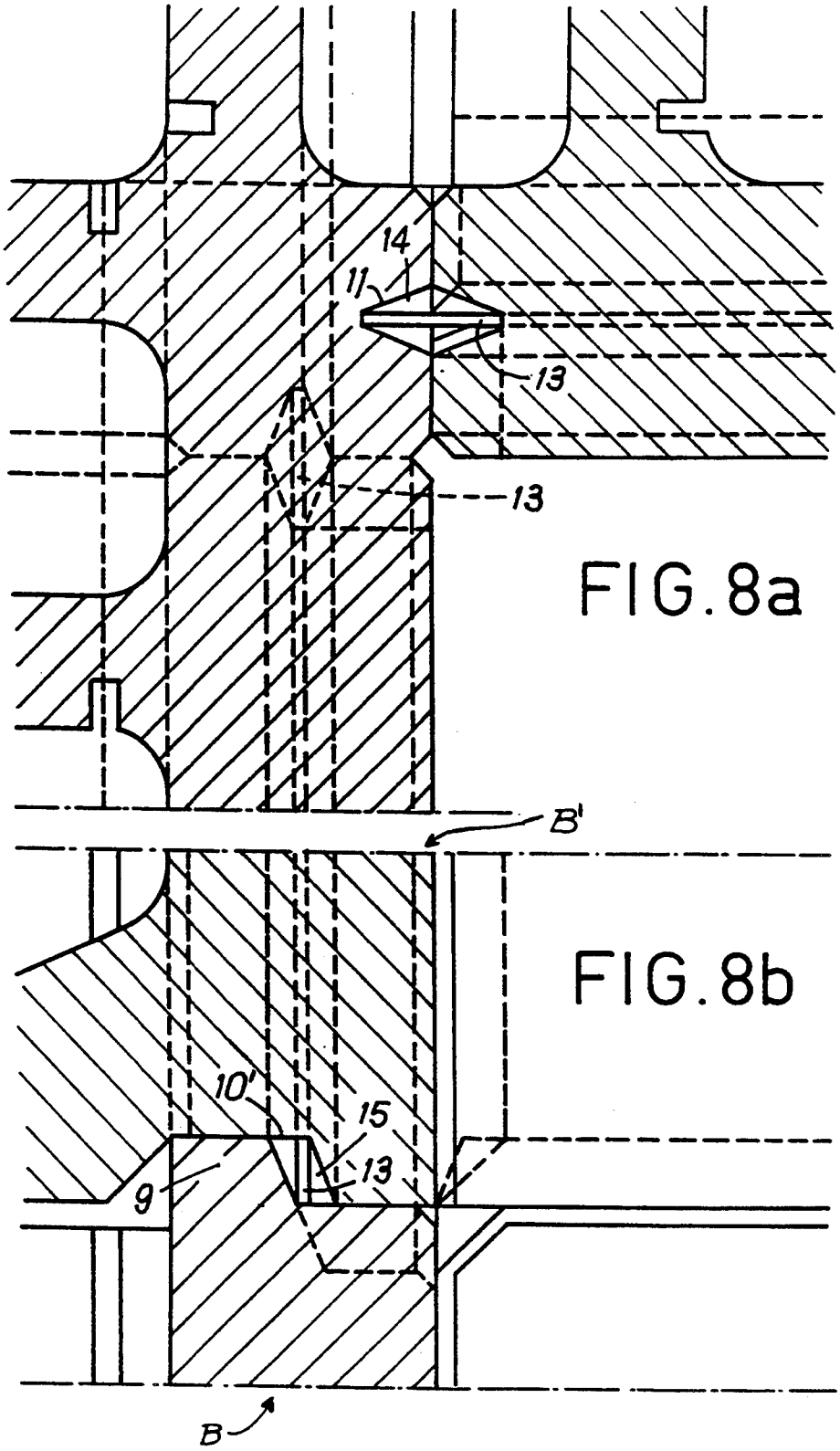

The invention will be more readily understood on reading the following description, with accompanying drawings, in which:

FIG. 1 is a plan view of a first embodiment of the invention,

FIGS. 2 and 3 are respectively cross-sectional and profile views of the block of FIG. 1, FIGS. 4 and 5 show a variant embodiment of the block according to the invention, in plan view and front view respectively, FIG. 6 is a plan view of another embodiment of the block, FIG. 7 is a plan view of yet another embodiment of the block according to the invention, FIGS. 8*a* and 8*b* are cross-sectional plan view and view from beneath, respectively, of two blocks according to the invention after assembly.

Figure 9:
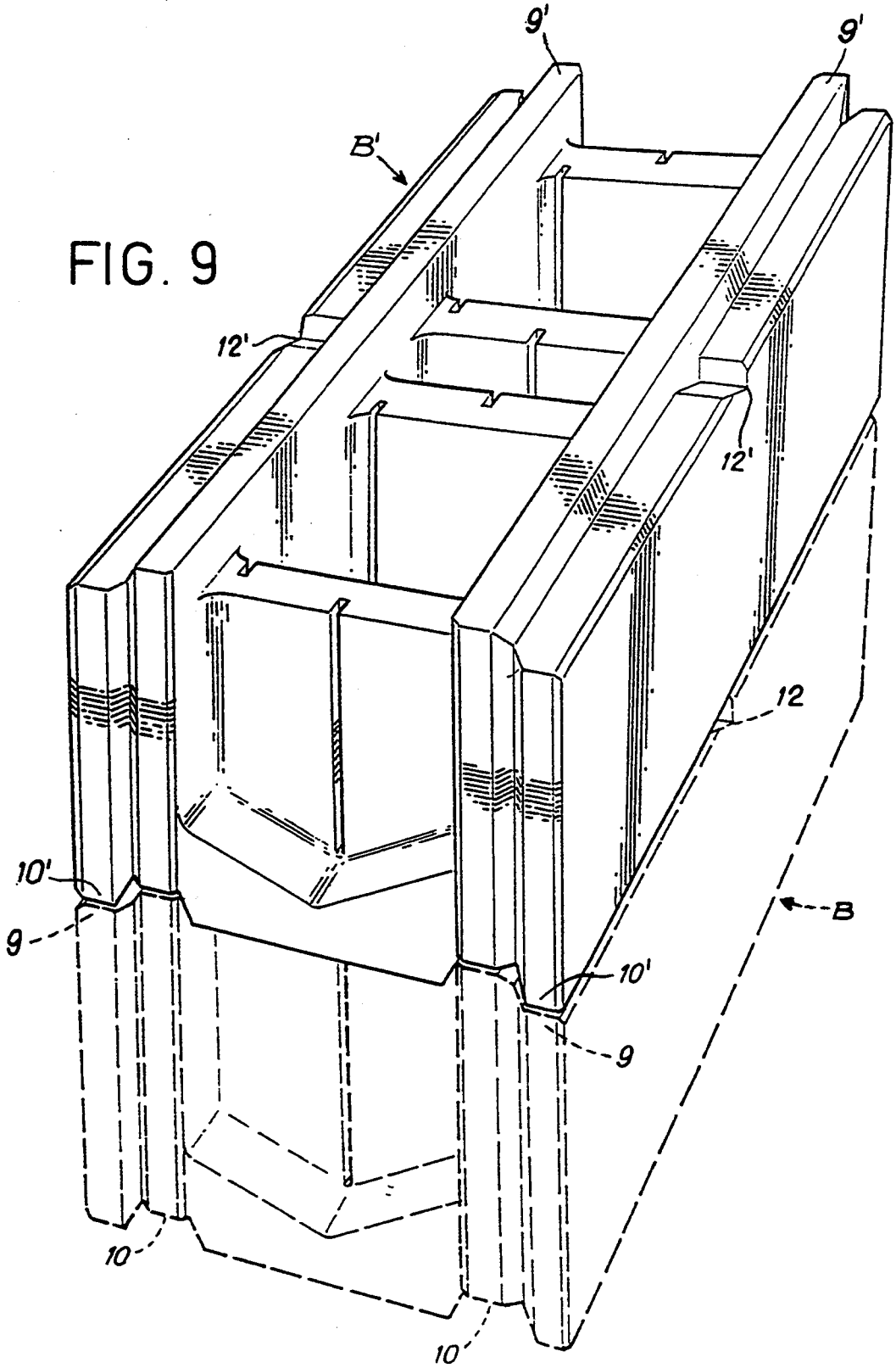

FIG. 9 is a perspective view of two blocks according to the invention, after assembly.

The element of construction according to the invention, such as illustrated in FIGS. 1 to 3, comprises a block B1 with six faces (1–6) opposite two-by-two.

The upper face 1 is punched so as to form open internal cells 7 separated by partitions 8, and the lower face 2 is solid.

Said block B1 is for example produced in parallelepipedal form, in concrete by molding.

Block B1 comprises ribs 9 and grooves 10 which extend in FIG. 1, in parallel to the longitudinal edges 1*a* throughout the length of, respectively, the upper face 1 and the lower face 2.

The dimensions and position of the ribs 9 are determined as a function of the dimensions and position of the grooves 10 such that the blocks B can be jointed together, without mortar, notably by engagement of the ribs 9 of a first block B into the grooves of an adjacent block B′ superposed on B.

To ensure the lateral assembly of the blocks B1, the ribs 9 extend vertically on the lateral end faces 3, 4 as illustrated in FIGS. 2 and 3.

Block B1 is also provided on the edges of the lateral faces 3, 4 with vertical grooves 11 of V-shaped cross-section opening out on the upper face 1 substantially plumb with the rib 9 and on the lower face 2 into the groove 10.

In FIGS. 1 to 3, block B1 still comprises, on the upper face 1, a transversal channel 12 of V-shaped cross-section, for draining out the run-off or condensation water. Channel 12 is placed perpendicularly between the edge 1*a* and the rib 9. The outer face 9*a* of the ribs 9 as well as the faces 10*a*, 10*b* of the grooves 10 are inclined.

The inner cells 7 vary in volume and open out onto upper face 1 only, while the end cells 7*a*, of smaller volume, also open out onto the lateral faces 3, 4.

Block B2, illustrated in FIGS. 4 and 5, is also parallelepipedal.

It comprises: an inner cell 7*b* opening out onto both the upper face 1 and the lower face 2, and a cell 7*c* opening out onto both the upper face 1 and the front face 5.

An end cell 7*a* opens out onto one of the lateral faces 4.

Ribs 9*a* are provided on the upper face 1, along the longitudinal edges 1*a* but over only one part of their length corresponding to substantially half the block. Block B2 further comprises ribs 9*b* along one of the lateral edges 1*b*.

Grooves 10 are provided on the lower face 2 along the longitudinal edges 1*a*.

Vertical grooves 11, 11' of V-shaped cross-section are formed on the lateral face 4 and on the front face 5 respectively. The grooves 11' open out onto the upper face 1 substantially plumb with the ribs 9*a*, 9*b*.

The rib 9*b* is for example adapted for engagement into the groove 10 of a block of type B1, superposed perpendicularly to B2, so as to form an angle.

A transversal channel 12 of V-shaped cross-section is disposed perpendicularly between the edge 1*a* and one of the ribs 9*a* but only on the edge opposite that onto which the vertical grooves 11' open out.

The block B3 illustrated in FIG. 6 is parallelepipedal and includes an internal cell 7*b* opening out onto the upper face 1 and the lower face 2.

The ribs 9 extend on the upper face 1 along each one of the longitudinal edges 1*a* but not through the whole length.

A flat zone 1*c* is thus left at one of the lateral ends of the upper face 1 between the end of the ribs 9 and the lateral edge 1*b*.

The block B3 further comprises transversal channels 12 of V-shaped cross-section disposed perpendicularly substantially in the middle of each side, between the rib 9 and the edge 1*a*.

Vertical grooves 11 are formed, as with the embodiment shown in FIG. 4, on the lateral face 4 only.

The lower face 2 comprises grooves 10 extending symmetrically with respect to the ribs 9 on the upper face 1.

The block B4, illustrated in FIG. 7, substantially corresponds to half the volume of the blocks B1–B3. It comprises an internal cell 7*b* opening out both onto the upper face 1 and onto the lower face 2 and a cell 7*a* opening out onto the lateral face 4 and the upper face 1.

The upper face 1 is provided with two ribs 9 leaving a flat zone 1*c* at one of the lateral ends in the vicinity of the edge 1*b*.

The block B4 further comprises vertical grooves 11 formed on the lateral face 4 and opening out onto the upper face 1 plumb with the ribs 9 and on the lower face 2 in the grooves 10.

The construction method using no mortar consists in jointing together the blocks B by engagement of the ribs of a first bloc into the grooves of an adjacent bloc, by selecting as a function of the location on the wall to be constructed, the types of blocks to be assembled and adjusted.

In order to improve insulation of the construction, the method according to the invention provides, as illustrated in FIGS. 8*a* and 8*b*, the insertion of vertical insulating tongues 13 forming a screen between the assembled blocks, identified as blocks B and B' in FIG. 8*b*, in the vertical spaces or conduits 14 defined by the walls in facing relationship of the vertical grooves 11, while resting in the horizontal channels 15 defined by the inclined face of the ribs 9 and the face of the grooves 10'.

FIG. 9 is a perspective drawing of two B1 type blocks, as depicted in FIGS. 1–3, superposed one on the other. The top block is identified as block B' and the lower block is identified as block B. Grooves 10' of block B' are shown engaging ribs 9 of block B.

I claim:

1. An element of construction to be laid without mortar, comprising a substantially hollow block having six faces including opposite top and bottom faces, two opposite end faces and two opposite side faces, wherein one of said faces is at least partially open and includes at least one opening therethrough to define at least one internal cell open on said at least partially open face of the block, wherein one of said faces is ribbed and includes at least two raised ribs which extend parallel to and are spaced from at least two edges of said ribbed face, wherein the face opposite said ribbed face is grooved and includes at least two grooves which extend parallel to and are spaced from at least two edges of said grooved face, said grooves being complementary in position and dimension to said ribs so that said blocks can be jointed together by engagement of the ribs of a first block with the grooves of a second, adjacent block, wherein the length of each of said ribs and grooves is no greater than the greatest dimension of the faces of the block on which said ribs and grooves are located, and wherein said ribbed face further includes at least one transverse drainage channel extending perpendicularly from at least one of said ribs to the nearest parallel edge from which said rib is spaced.

2. The element of construction of claim 1 wherein said ribs and grooves each have at least one inclined surface.

3. The element of construction of claim 2 wherein said ribbed face is the top face and said grooved face is the bottom face.

4. The element of construction of claim 3 wherein the inclined surfaces of the ribs and grooves are shaped so that when one of said blocks is jointed on top of another of said blocks, with said ribs engaging said grooves, the inclined surfaces of the ribs and grooves define a horizontal channel extending along the length of the intersection of said ribs and grooves.

5. The element of construction of claim 4 wherein said transverse drainage channel intersects said horizontal channel for drainage of said horizontal channel.

6. The element of construction of claim 4 wherein at least one horizontal rib on said ribbed top face extends to an edge of the top face intersecting a perpendicular lateral face, and at least one horizontal groove on said grooved bottom face extends to an edge of the bottom face intersecting the same lateral face at a point directly below the intersection with said rib, wherein said lateral face further includes a substantially V-shaped vertical groove formed therein and extending between the intersections of said horizontal rib and said horizontal groove with said lateral face, and wherein said vertical groove issues into the ribbed top face substantially plumb with said horizontal rib, and issues into said horizontal groove of the grooved bottom face, or immediately adjacent thereto.

7. The element of construction of claim 6 wherein said transverse drainage channel intersects said horizontal channel for drainage of said horizontal channel, and said horizontal channel intersects said vertical channel for drainage of said vertical channel.

8. The element of construction of claim 3 wherein said at least partially open face is the top face.

9. The element of construction of claim 8 wherein at least one internal cell is also open on the bottom face.

10. The element of construction of claim 8 wherein the bottom face is a solid wall, so that no internal cell opens onto the bottom face.

11. The element of construction of claim 3 wherein at least one rib is oriented perpendicular to another rib.

12. The element of construction of claim 1 wherein said block is a parallelepiped.

13. The element of construction of claim 12 wherein said block is cubical in form.

14. A construction method for assembling, without mortar, blocks made in accordance with claim 1, said method comprising the steps of:

positioning vertical grooves of two adjacent blocks in facing relationship to define vertical spaces between the adjacent blocks, jointing additional blocks on top of said adjacent blocks, with said ribs engaging said grooves so that the surfaces of the ribs and grooves define horizontal channels extending along the lengths of the intersections of said ribs and grooves, and inserting insulating tongues into the spaces between the adjacent blocks, with the tongues resting in the horizontal channels formed by the intersections of the ribs and grooves.

* * * * *